US008766149B2

(12) United States Patent
Sadler

(10) Patent No.: US 8,766,149 B2
(45) Date of Patent: Jul. 1, 2014

(54) DEVICE FOR MAGNETIC HEAT INDUCTION AND EXCHANGE TO MOBILE STREAMS OF MATTER

(75) Inventor: George D. Sadler, Orland Park, IL (US)

(73) Assignee: Prove IT, LLC, Geneva, IL (US)

( * ) Notice: Subject to any disclaimer, the term of this patent is extended or adjusted under 35 U.S.C. 154(b) by 110 days.

(21) Appl. No.: 13/128,654

(22) PCT Filed: Oct. 26, 2009

(86) PCT No.: PCT/US2009/061998

§ 371 (c)(1),
(2), (4) Date: Jul. 8, 2011

(87) PCT Pub. No.: WO2010/056493

PCT Pub. Date: May 20, 2010

(65) Prior Publication Data

US 2011/0259878 A1 Oct. 27, 2011

Related U.S. Application Data

(60) Provisional application No. 61/113,614, filed on Nov. 12, 2008.

(51) Int. Cl.

| | |
|---|---|
| ***H05B 6/10*** | (2006.01) |
| ***H05B 6/06*** | (2006.01) |
| ***H05B 6/02*** | (2006.01) |

(52) U.S. Cl.
USPC ..... 219/635; 219/637

(58) Field of Classification Search
USPC ..... 219/635–646, 94, 97, 114, 127, 136, 219/373, 121.11, 121.36, 121.48, 121.54, 219/121.49, 121.5, 121.51, 121.43, 121.57, 219/121.59; 315/111.21–111.81; 250/423 R, 424; 156/345.38, 345.48; 204/298.31
See application file for complete search history.

(56) References Cited

U.S. PATENT DOCUMENTS

| | | | | |
|---|---|---|---|---|
| 6,610,921 | B1 | 8/2003 | Brannon | |
| 2003/0071035 | A1 * | 4/2003 | Brailove | 219/672 |

(Continued)

FOREIGN PATENT DOCUMENTS

| | | | |
|---|---|---|---|
| JP | 09-279228 | A | 10/1997 |
| JP | 2003-227687 | A | 8/2003 |

(Continued)

OTHER PUBLICATIONS

Tae-U Lee, Method of Treating Perfluoro-Carbon Compound Gas andApparatus for Treating Thereof, Oct. 19, 2002, Korean Patent Translation.*

International Search Report for PCT/US09/61998 dated May 19, 2010. Applicant: Provelt LLC.

*Primary Examiner* — Dana Ross
*Assistant Examiner* — Michael Laflame, Jr.
(74) *Attorney, Agent, or Firm* — Burns & Levinson LLP; Jacob N. Erlich; Marlo Schepper Grolnic

(57) ABSTRACT

A device is described for magnetic heat induction and subsequent heat exchange to mobile streams of matter. The device can provide efficient heating of moving gaseous, liquid, or solid masses. A cold mass is made to flow past an induction heated workpiece, whereby the cold mass becomes heated via thermal transfer from the workpiece to the cold mass. The device can include a material susceptible to heating by magnetic induction that is inserted into a tube or other containment structure. The tube can be the transport conduit for the material to be heated. An induction coil can surround the tube. The coil can be connected to a high energy LC (inductance-capacitance) resonance circuit. Resonance generates magnetic flux in the coil. The flux can interact with the workpiece inside the tube. Heat can be generated in the workpiece and can then be transmitted to the cold mass as it is conveyed past the workpiece.

20 Claims, 6 Drawing Sheets

(56) References Cited

U.S. PATENT DOCUMENTS

| | | | | |
|---|---|---|---|---|
| 2005/0230047 | A1* | 10/2005 | Collins et al. | 156/345.33 |
| 2006/0037946 | A1* | 2/2006 | Zeltner | 219/121.7 |
| 2006/0186109 | A1* | 8/2006 | Goto et al. | 219/444.1 |
| 2006/0289493 | A1* | 12/2006 | Thomas et al. | 219/660 |

FOREIGN PATENT DOCUMENTS

| | | | |
|---|---|---|---|
| KR | 2002-0079343 | A | 10/2002 |
| KR | 10-0663328 | B1 | 1/2007 |
| KR | 10-2007-0035334 | A | 3/2007 |

* cited by examiner

DEVICE FOR MAGNETIC HEAT INDUCTION AND EXCHANGE TO MOBILE STREAMS OF MATTER

CROSS-REFERENCE TO RELATED APPLICATIONS

This application is a U.S. national stage application under 35 U.S.C. 371 of International Application No. PCT/US2009/061998 filed on Oct. 26, 2009 and entitled DEVICE FOR MAGNETIC HEAT INDUCTION AND EXCHANGE TO MOBILE STREAMS OF MATTER, which in turn claims priority to U.S. Provisional Application No. 61/113,614, filed on Nov. 12, 2008.

BACKGROUND

The present embodiment relates generally to magnetic induction heating and more specifically to a device for magnetic heat induction and heat exchange to mobile streams of matter.

What is needed is a system that can provide efficient heating of a flowing gaseous, liquid or solid mass, and can also provide a relatively small footprint. What is further needed is a heating method for mobile streams of matter capable of precise and rapid temperature regulation. What is still further needed is a system that can adapt to conventional machinery and can replace conventional steam-supplied heat transfer technology. What is even still further needed is a system that is amenable to automated control via existing computer or other control strategies. What is even still further needed is a system that fluid-cools magnetic induction unit components while it collects the heat from the cooling fluid to preheat a cold mass, and heats the cold mass using a magnetic induction heated heat transfer surface.

SUMMARY

The needs set forth herein as well as further and other needs and advantages are addressed by the present embodiments, which illustrate solutions and advantages described below.

The purpose of the magnetic induction heat generator and exchanger is to provide efficient heating of flowing gaseous, liquid or solid masses, collectively referred to as mass, in which a cold mass is made to pass or flow, through pumping, gravity feed, augur, or other means, past an induction-heated material or workpiece, whereby the cold, flowing mass becomes heated through thermal transfer from the workpiece to the cold, flowing mass. Additionally, heat from the device is reclaimed and used to heat the mass, while a medium which cools during the heating process can be used to cool the heated mass following its processing.

The magnetic induction heating device of the present embodiment can include, but is not limited to including, a workpiece that can be a conduit for the cold mass. Further, the workpiece can be inserted into a containment structure such as, for example, a tube. An induction coil can surround the workpiece. The induction coil can be connected to, for example, a high energy LC (inductance-capacitance) resonance circuit. Resonance can generate magnetic flux in the coil. The flux can interact with the workpiece (the interaction is hereafter referred to as "couples with" or "coupling"). Heat can be generated in the workpiece and can then be transferred to the flowing mass. Heat can also be reclaimed throughout the device and reused, while the medium flowing through the induction coil can provide both pre-warming to the cold mass or cooling to the heated mass.

The method of the present embodiment for heating a mass can include, but is not limited to including, the steps of introducing the mass to a workpiece forming a mass/workpiece combination, the mass/workpiece combination being surrounded by a coil, the mass/workpiece combination including electrically conductive material, delivering an alternating current from a power source to the coil, inducing a current in the workpiece to produce heat, heating the mass with the heat, cooling the power source and the coil with a cooling medium to form a heated medium, preheating the mass using the heated medium to restore the cooling medium, and cooling the heated mass with the cooling medium. The method can optionally include the steps of surrounding the workpiece with a tube, isolating the coil from the workpiece, providing the mass to a plurality of channels or plates in the workpiece, and sensing the temperature of the mass.

The method for manufacturing a heating device to heat a mass according to the present teachings can include, but is not limited to including, the steps of manufacturing a workpiece that can include electrically conductive material, encircling the workpiece with a coil, operatively connecting a power source to the coil, the power source capable of delivering an alternating current to the coil to induce a current in the workpiece to produce heat. The heat can heat the mass and provide a cooling medium capable of circulating around the heating device, where the cooling medium can capture the heat and form a heated medium. The cooling medium can cool the power source, the coil, and the heated mass. The method can include the step of coupling a relatively warm end of the workpiece with a relatively cool end of the workpiece by a heat exchanger, the heat exchanger preheating the mass using the heated medium to restore the cooling medium. The method can optionally include the steps of manufacturing the workpiece from electrically conductive material, fitting the workpiece inside a tube, and isolating the coil from the tube. The method can still further optionally include the steps of manufacturing the tube from dielectric material, surrounding the power source with insulation, including channels or plates in the workpiece, and operatively coupling a temperature sensor with the mass.

The heating device for heating a mass of the present embodiment can include, but is not limited to including, a workpiece to which the mass is introduced. The workpiece and the mass can form a mass/workpiece combination, which can include electrically conductive material. The heating device can further include a coil surrounding the mass/workpiece combination, and a power source delivering an alternating current to the coil. The alternating current can induce a current in the mass/workpiece combination to produce heat, the heat can heat the mass, and a cooling medium can capture the heat and form a heated medium. The heated medium can heat the mass, and the cooling medium can cool the power source, the coil, and the heated mass to restore the heated medium. The heating device can optionally include a tube surrounding the mass/workpiece combination. The tube can be isolated from the coil, and the tube can include dielectric material. The workpiece can further optionally include a plurality of channels or plates. The heating device can further optionally include insulation surrounding the power source and also a temperature sensor to at least sense the temperature of the mass. The cooling medium and the heating medium can include water.

Other aspects of the present teachings will become obvious to the reader and it is intended that these aspects are within the scope of the present teachings. To the accomplishment of the above and related objects, these teachings may be embodied in the form illustrated in the accompanying drawings, in which like reference characters designate the same or similar parts throughout the several views. The drawings are illustrative only, and changes may be made in the specific construction illustrated and described within the scope of this application.

DETAILED DESCRIPTION

Figure 1:
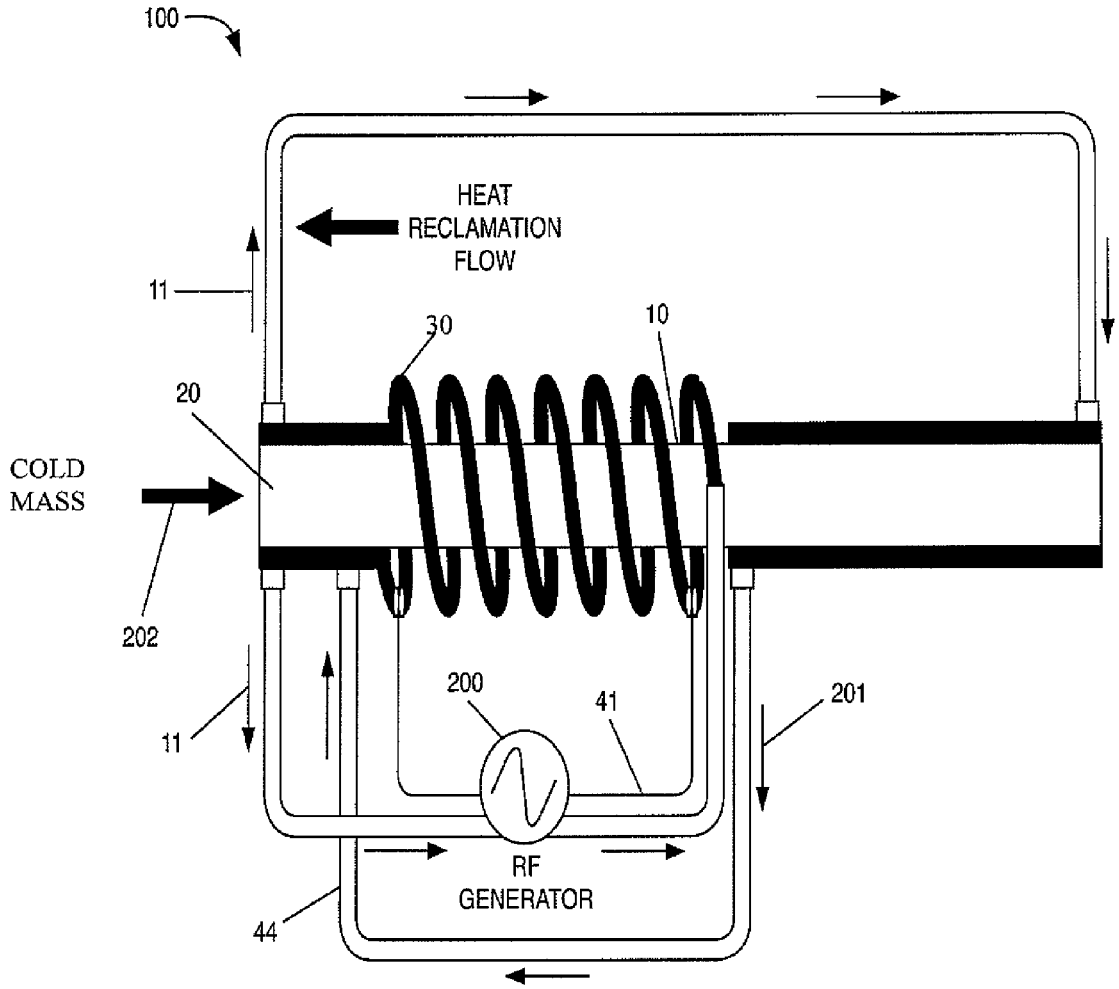
FIG. 1 is a schematic diagram of the system of an embodiment of the present teachings.

Before the present embodiments are described, it is understood that this disclosure is not limited to the particular devices, methodology and components described as these may vary. It is also to be understood that the terminology used herein is for the purpose of describing particular embodiments only, and is not intended to limit the scope of this disclosure. The following configuration descriptions are presented for illustrative purposes only. Any configuration and architecture satisfying the requirements herein described may be suitable for implementing the system and method of the present embodiments.

It should be further understood that as used herein and in the independent claims, the singular forms "a," "an," and "the" include plural reference unless the context clearly dictates otherwise. Thus for example, reference to "a coil" can include a plurality of such coils. Unless defined otherwise, all technical and scientific terms used herein have the same meanings as commonly understood by one of ordinary skill in the art to which these teachings belong.

It is to be understood that these teachings are not limited to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

Historically, petroleum-derived heat has been cheap. However, dwindling reserves, global instability, and the caprices of weather have encouraged petroleum prices which are volatile and generally escalating. Global competition for shrinking oil reserves will likely continue upward pressures on petroleum prices. In contrast, domestic coal reserves can be insulated from global/environmental price pressures. There are government and profit incentives to develop alternative and especially renewable sources of energy such as solar, wind and nuclear fusion. Unlike current petroleum products which have direct access to end uses through utility pipelines, alternative forms of energy are either created-as, or must be converted-to electricity.

Thus it is possible that petroleum-based direct-delivery utilities will reduce in importance compared with coal-, alternative- and renewable energy-electric utilities. Adapting processing industries to this likely change could be a challenge possibly requiring, in the case of an all-electric future, heating systems that are optimally efficient in converting electricity to heat. Currently, this task is most often performed by resistance heaters of the type found in electric hot-water heaters. However, the very nature of a circuit design insures some current will flow back to the source unused and therefore will be unavailable for generating heat within the resistance element. Heating along the resistance element can be non-uniform. Non-uniform heating can encourage bake-on of materials at the hottest surfaces of the resistance element. Direct contact heating of food with resistance elements can require intrusion of high voltage current into the mass-bearing pipe where shorting could introduce an electrocution hazard.

Referring now to FIG. 1, magnetic induction of system 100, in contrast, oscillates current back-and-forth in a coil 30 between an inductance (L) and a capacitance (C). Inside coil 30 is tube 20 used to convey cold mass 202 to be heated. Tube 20 in the induction stage is connected via standard commercial fittings to standard tubing both before and after the heating stage. Cold mass 202 passes through standard commercial fittings in workpiece 10. Coil 30 does not touch workpiece 10, which can therefore be isolated in, for example, non-electrically conductive tube 20. In one embodiment, approximately 83% of the electricity delivered to coil 30 is converted to heat in workpiece 10 inside tube 20/workpiece 10 assembly. Much of the remaining 17% of the energy appears as heat in high power electronics 200 and though self-heating of coil 30. However, both electronics 200 and coil 30 can be cooled by cooling medium 11. Thermal energy residing in heated medium 201 can be collected in thermal regeneration to heat cold mass 202. As an example, the theoretical efficiency of electric-energy-to-food-heat for induction heating plus thermal reclamation approaches 97%. Heated cold mass 202 can also be cooled with cooling medium 11 for thermal reclamation.

Continuing to refer to FIG. 1, cold liquid, gas or solid 202 enters tube 20 from the left side of FIG. 1, which is the heating portion of system 100. The heating portion can include tube 20 which can be, but is not limited to being, made of a dielectric material. Inside tube 20 is workpiece 10, which can be, but is not limited to being, a bundle of tubes for fluid transport. Tube 20 and workpiece 10 are positioned inside coil 30 which is hollow to accommodate water cooling. Cold mass 202 enters system 100 and is transported by pump 65 (FIG. 3) through tube 20 containing workpiece 10 which has been heated by induction. Cold mass 202 is heated by thermal transfer from workpiece 10. As cold mass 202 is heated, some electric energy is lost to heat in workpiece 10, and some energy is lost as heat in coil 30. This heat is collected by water passing through coil 30. Heated medium 201, which can be, but is not limited to being, water, in coil 30 which is heated can be used to preheat cold mass 202 before it enters tube 20. Cold mass 202 becomes heated material that flows out of tube 20 at a preselected temperate. The heat from the heated material can be collected and re-used using any one of several commercial devices designed for thermal reclamation. Workpiece 10 can be formed to create an optimal and efficient coupling between workpiece 10 and an induced magnetic field. An efficient coupling provides for the highest interaction between the magnetic flux and workpiece 10. Coil 30 is one geometry that can be used, but others are possible, depending on the geometry of system 100. Coil 30 can be helically shaped, for example. If, on the other hand, cold mass 202 is introduced to a plate-shaped workpiece 10, coil 30 could be placed between the plates. In an exemplary embodiment, power supplied to coil 30 and the length of coil 30, among other things such as, for example, flow rate of mass 202 and type of mass 202, govern undesirable bake-on.

Figure 2:
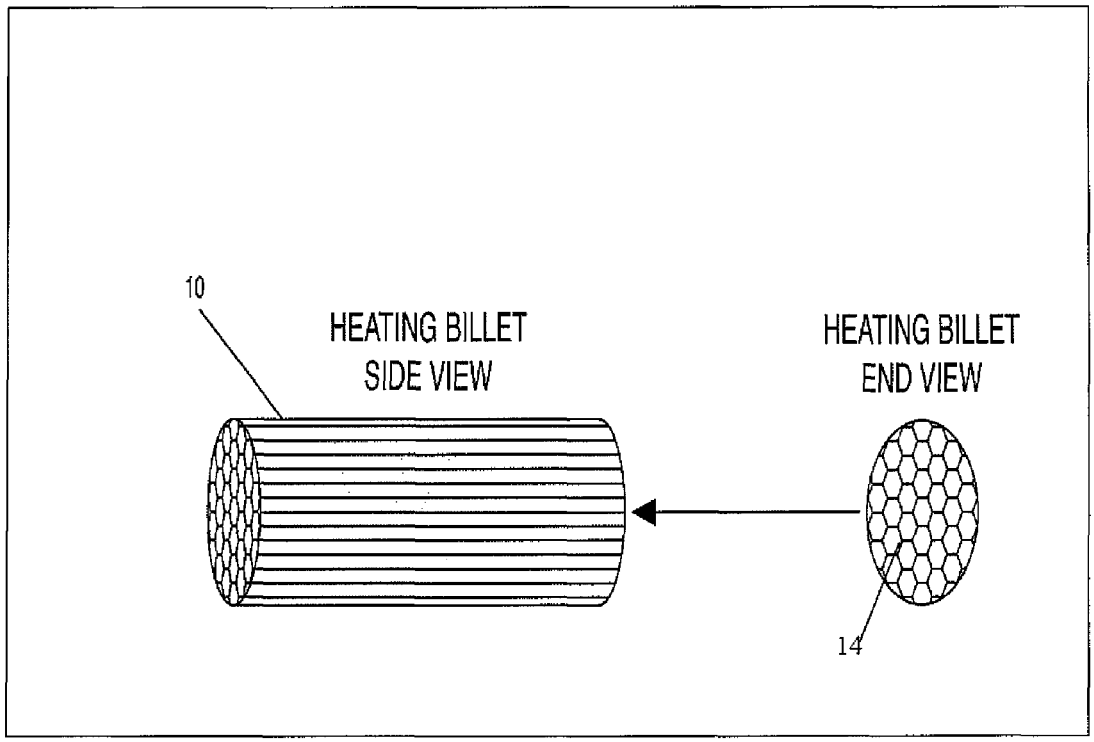
FIG. 2 is a schematic diagram of the matter transfer tube bundle of the present embodiment.

Referring now to FIG. 2, workpiece 10 can include channels (14) or other provisions that allow adequate flow and intimate contact between cold mass 202 and workpiece 10. For example, workpiece 10 can be a two-bundle of eight tubes, two feet long, ¼-inch openings, and 316-stainless (food grade). As cold mass 202 flows past inductively-heated workpiece 10, heat exchange from workpiece 10 to cold mass 202 occurs. Certain masses may be of such a composition that a fraction of the induction heating will occur within the mass itself. Workpiece 10 may be, for example, a simple channel (14), a bundle of channels (14) (as shown in FIG. 2), or it may have various design provisions to invoke a tortuous flow path, to increase surface area, to induce convection, to optimize coupling, or to otherwise facilitate heat exchange between workpiece 10 and cold mass 202. Workpiece 10 may be, for example, a single piece or multiple pieces made from one or from many materials. Workpiece 10 may be, for example, made of metal tubes, or plates, or metal wool, for example, steel wool, or fabric, for example, graphite fabric, or potentially any other material susceptible to magnetic induction and any other design that favors coupling with coil 30, or facilitates heat exchange to cold mass 202. Workpiece 10 may be, for example, fixed and static or its position may vary in response to forces brought about by flowing of cold mass 202. Workpiece 10 may be, for example, tube 20 that conveys cold mass 202 through the induction stage. When tube 20 serves the dual function of workpiece 10 and tube 20, the exterior or interior of tube 20 may be modified in, for example, geometric form or material composition to increase mass heating efficiency. This might be done, for example, to increase coupling with the magnetic flux (via physical design or through material selection) or to force convection in cold mass 202. Alternatively, workpiece 10 can be separate from tube 20 and inserted inside tube 20 with no physical contact between coil 30 and workpiece 10. Workpiece 10 may be composed of several elements. One, some, or all of these elements will be susceptible to magnetic heat induction. Workpiece 10 can be, for example, solid and fixed, for example as a tube bundle, or it can, for example, yield in some way to the flow of cold mass 202, for example metal wools, ribbons of induction susceptible materials, or springs. Workpiece 10 can be, for example, fixed inside the induction phase, or it can be, for example, added to cold mass 202 before cold mass 202 enters the induction stage. For example, iron filings can be added to crushed oil shale which can become heated in the induction stage. Such additives can be later magnetically removed and recycled. Alternatively, salts can be added to a food to enhance coupling with the magnetic flux in the induction phase.

Referring again to FIG. 1, coil 30 can be, for example, copper or silver, i.e. highly conductive with a relatively low thermal increase. Coil 30 can be, for example, two feet long and can have, for example, an inner diameter of two inches. Tube 20 can be 316-stainless, sixteen millimeters outer diameter, and 1.5-inch inner diameter. Induction coil 30 can be connected to, for example, high energy LC (inductance-capacitance) resonance circuit 200. Resonance generates magnetic flux in coil 30. The flux couples with workpiece 10 to generate heat. Heat generated in workpiece 10 is then transferred to cold mass 202. Workpiece 10 of suitable length, geometry, and material composition for efficient heating is inserted inside tube 20.

Continuing to refer to FIG. 1, tube 20 can be constructed of suitable length, geometric profile, and material composition for efficient heating when tube 20 is inserted into induction coil 30. Tube 20 can serve as the transport conduit for cold mass 202. Tube 20 can be made, in whole or in part, of a substance susceptible to magnetic heat induction including, but not limited to, metal, graphite, certain composite materials, or alternatively, tube 20 can be composed of a material that is not susceptible to heating by magnetic induction such as, for example, plastics, glass, and ceramics. Unless tube 20 serves a secondary function as workpiece 10, the main function of tube 20 is to covey cold mass 202 through the induction stage with minimal flux coupling. The composition of coil 30 can be determined, for example, by the composition of cold mass 202 and the desired end-temperate. Coil 30 made of plastic tubes can be suitable for certain applications, for example, low temperature aqueous applications such as pasteurization of foods. Metals, ceramics or other refractory materials can be used in high temperature applications such as, for example, food sterilization or petroleum refining. Tube 20 may be a simple cylinder or it may contain external or internal modifications that can increase induction coupling with workpiece 10 and/or can increase the transfer of induced heat to cold mass 202. Single or multiple tubes 20 may have, for example, single or multiple coils 30 that can either surround all tubes 20 at once or each individually. Tube 20 may be a straight cylinder, patterned in some way—for example, fluted—coiled or contain other geometric and compositional features that can enhance heat exchange or decrease the size of the induction unit. Tube 20 can also be plates either singly or as stacks of plates. Depending on the desired end-use, tube 20 can be composed of any material able withstand the temperature and pressure needs of the intended application.

Continuing to still further refer to FIG. 1, induction coil 30 can be made of, for example, copper, although other materials are possible. Coil 30 can be hollow to allow removal of coil-heat by heated medium 201. LC-generated resonance can set up an oscillating magnetic field inside coil 30. Workpiece 10 can couple with the magnetic field and become heated. For greatest electric-to-heat efficiency of system 100, heat in heated medium 201 may be collected using commercial regeneration devices to preheat cold mass 202 prior to its entering the induction heating stage. One or many coils 30 may be used for heating workpiece 10. Induction coil 30 can be matched with a capacitor to provide resonance in a frequency range ideally suited to workpiece 10, for example, in the radio frequency range. Coil 30 can be tailored to provide optimal coupling with unique features of workpiece 10 or configuration of the tube 30. Heat generated in the electronics, in coil 30, and in cold mass 202 after it is heated can be reclaimed and used to pre-heat cold mass 202 before cold mass 202 enters the induction heating stage. Thermal reclamation can increase the electric-power-to-mass-heat conversion efficiency of the system. Cold mass 202 can enter the induction stage from a pre-induction stage. Heat can be generated in workpiece 10 and transferred to cold mass 202. After cold mass 202 receives an adequate thermal treatment, cold mass 202 that has been heated may be cooled by cooling medium 11, for example, but not limited to, water, to near the temperature of cold mass 202. A heat exchanger can be used to transfer heat from heated medium 201 to cold mass 202 in the pre-induction stage of the process. Reclamation of this energy can increase the efficiency of system 100. Similarly, heat generated in the electronics 200 can be collected and reclaimed. Some heat is also generated in induction coil 30. This energy can likewise be reclaimed and used to pre-heat the cold mass 202 in the pre-induction stage. Heat exchangers can be, but are not limited to being, counter-current tube-in-shell design, plate, and other heat exchanger designs. Heated cold mass 202 can be used directly to pre-heat cold mass 202 in the pre-induction stage. A secondary heat exchange medium 201 can remove heat from heated cold mass 202 with subsequent transfer to the pre-induction stage.

Continuing to still further refer to FIG. 1, cold mass 202 flows through system 100 by a means of conveyance used such as, but not limited to, pumping, gravity feeding, augurs, belts, and coverers. Highest electric-power-to-mass heating efficiency occurs when cold mass 202 is preheated in the pre-induction stage with thermal energy reclaimed from heated cold mass 202 exiting the induction stage, from heat generated in electronics 200, and from heat generated in coil 30. Cold mass 202 passes from the pre-heating stage (when used) to the induction stage. Workpiece 10 is heated via magnetic induction. As cold mass 202 flows past workpiece 10, heat is transferred from workpiece 10 to cold mass 202. The temperature of heated cold mass 202 exiting workpiece 10 is monitored by, for example, thermocouple 32 (FIG. 3) or another measuring device. If the temperature is too hot, power to coil 30 is reduced by automated control provided as part of feedback circuit 41 of the magnetic induction unit. Similarly, if the temperature falls below a preselected setpoint, the power to coil 30 is increased and temperature is increased. The rate of temperature adjustment and precision of the end-point temperature can depend on both the sensitivity of the temperature measuring device and the induction circuit. Magnetic induction heating can be automatically controlled by electronics. Heated cold mass 202 exits the induction stage and, depending on the requirements of the material, can be cooled by thermal reclamation, by flash cooling, by simple passive exchange with the surrounding environment, or by some other suitable cooling process which can provide optimal post-heating properties to the heated cold mass 202. The induction field is supplied by induction coil 30 surrounding tube 20 which houses workpiece 10, or by tube 20 if tube 20 also serves as workpiece 10. Various methods exist to optimize induction heating for a specific application. These include, but are not limited to, the geometric design of coil 30 and workpiece 10, the materials used to construct coil 30 and workpiece 10, the flow rate of cold mass 202 past workpiece 10, the frequency used for heating workpiece 10, the length of workpiece 10, the amount of magnetic flux coupling between coil 30 and workpiece 10, and the number of coils 30 and workpieces 10 per line. For magnetic induction heating, coil 30 can, for example, replace the need for a steam boiler and workpiece 10 can take the place of a heat exchanger. Therefore, compared to steam heating the physical footprint of the induction heating system is very small for comparative heat delivery via steam.

Continuing to refer to FIG. 1, as an alternative to heating cold mass 202 by direct contact with workpiece 10, workpiece 10, tube 20, and coil 30 can heat a heat exchange medium such as, for example, a stream of water, which can exchange heat with cold mass 202 by means of a commercial heat exchange device. Induction can also be used to generate steam. For example workpiece 10 made from, for example, steel wool or another similar material, can be heated inside tube 20 which may either be open or closed to the external environment. Tube 20 can include a contact medium such as water that is in contact with workpiece 10. As induction heats workpiece 10, the contact medium can be vaporized into, for example, steam, and delivered to the target heating surface using existing steam transfer technology. Induction can allow steam to be generated with high electric to heat efficiency and in close proximity to the target, and can allow condensed hot contact medium to trickle back down to the heating stage to be re-vaporized into steam. The short path and reuse of heated contact medium can increase thermal efficiency compared to conventional steam boilers. Recycling the hot medium can potentially eliminate lime and scale buildup in process lines.

Referring finally to FIG. 1, heating device 100 for heating a mass 202 of the present embodiment can include, but is not limited to including workpiece 10 for receiving mass 202. Workpiece 10 and mass 202 can form a mass/workpiece combination that can include electrically conductive material. Heating device 100 can also include coil 30 surrounding the mass/workpiece combination, and power source 200 delivering an alternating current to coil 30. The alternating current can induce a current in the mass/workpiece combination to produce heat that can heat mass 202. Heating device 100 can further include cooling medium 11 that can capture the heat and can form heated medium 201. Heated medium 201 can heat mass 202. Cooling medium 11 can cool power source 200, coil 30, and the heated mass which process can transform cooling medium 11 to heated medium 201. Heating device 100 can optionally include tube 20 surrounding the mass/workpiece combination. Tube 20 can be isolated from coil 30, and can include dielectric material. Workpiece 10 can include a plurality of channels 14 or plates, insulation can surround power source 200, and at least one temperature sensor 32 (FIG. 3) can be include to sense at least the temperature of mass 202. Cooling medium 11 and heated medium 201 can both include water.

Figure 3:
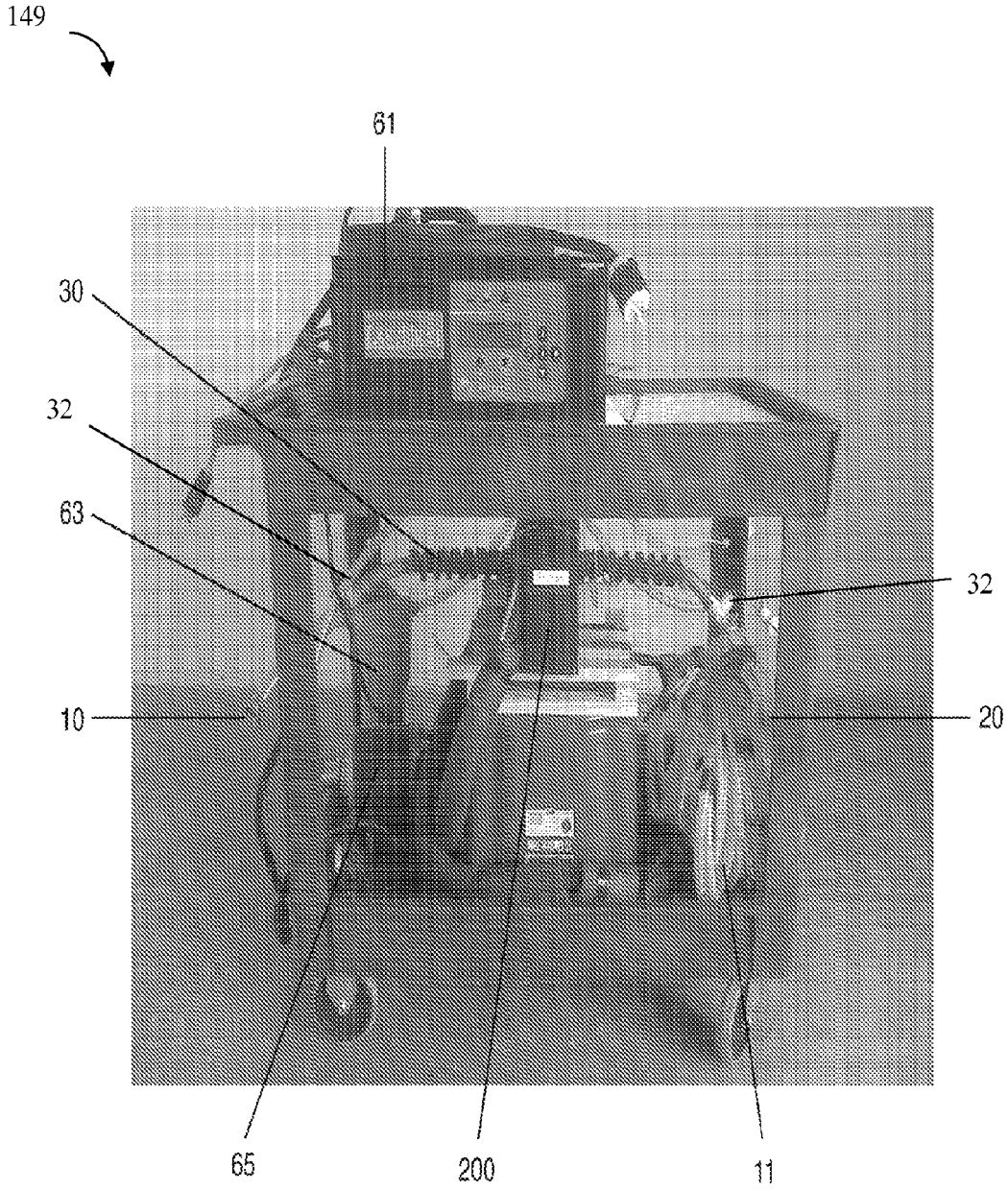
FIG. 3 is a photographic depiction of a prototype of the magnetic induction system of the present embodiment.

Referring now to FIG. 3, prototype 149 of system 100 (FIG. 1) is shown. Electric energy delivered to the control panel 61 can resonate between capacitor bank 200 and induction coil 30. A 316 stainless steel tube bundle is heated inside dielectric food transfer tube 10/20 and exchanges heat with the food stream in the region of induction coil 30. In the present embodiment, coil 30 can remain cool to the touch, there is no electric shock hazard, and no shielding is required. Approximately 80% of the electric energy supplied to prototype 149 results in direct food heating. Approximately 15% of the electric energy heats induction coil 3 and other electronic components. However cooling water reclaims this electrical component heat through cooling water delivered through a path consisting of cooling water lines 11, pump 65, water filter 63, control panel 61, capacitor bank 200, coil 30, and the exit leg of cooling water tube 11. The cooling water heat is recovered to pre-heat product entering food transfer line 10 prior to the heating stage. Thermocouples 32 monitor temperature and supply feedback signal for controlling temperature. The remaining 5% of electric energy is lost through other productive loads such as LEDs, LCD's, and as a function of internal electronics work. A small fraction is lost unproductively to the environment as heat.

Figure 4:
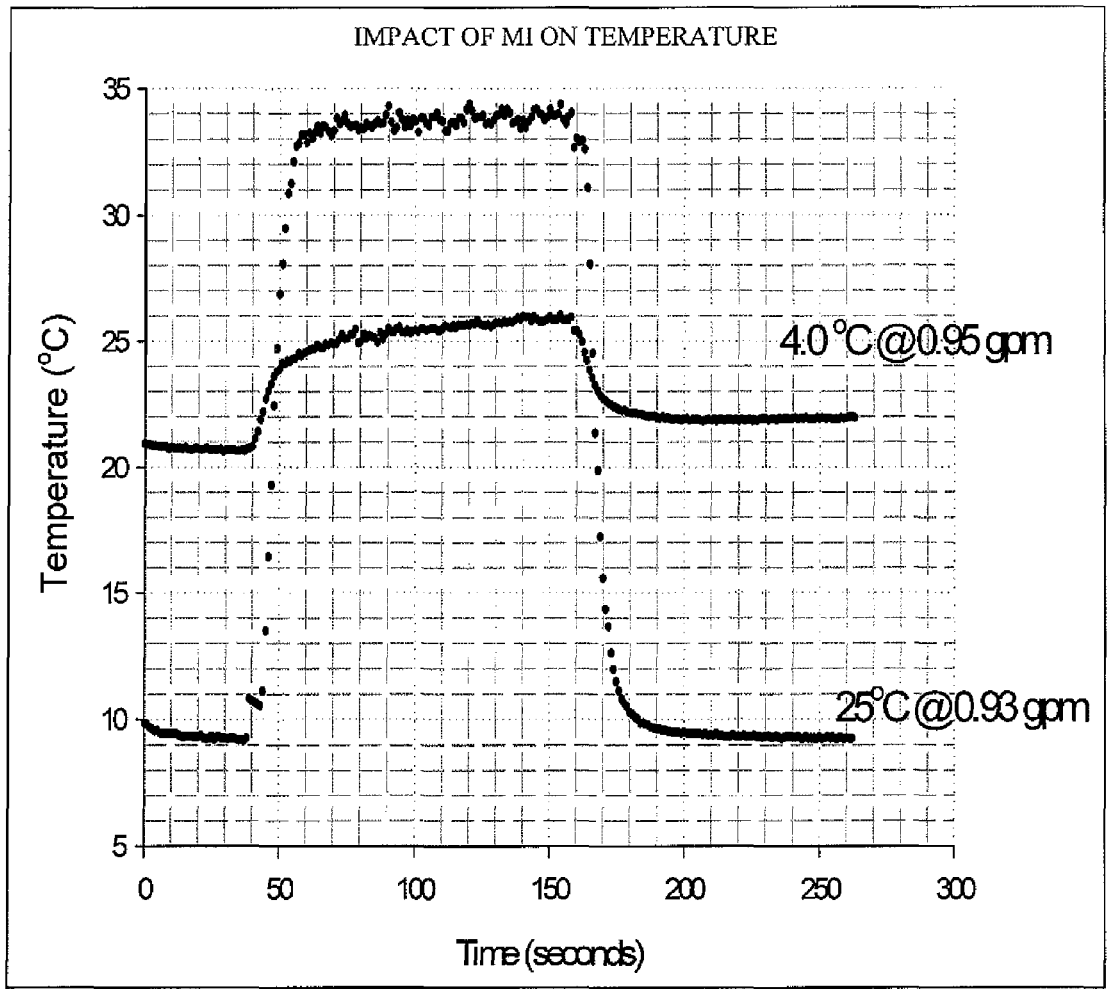
FIG. 4 is a graphical depiction of the temperature variation of the mass subject to heating according to the present teachings.

Referring now to FIG. 4, the graph illustrates the impact of magnetic induction on water temperature during an illustrative experiment using the system of the present embodiment. In the illustrative experiment, electric output ranged from 7500 W to 7800 W. Power was applied at the 37-second mark. Plot 51 illustrates temperature rise for food passing through the transfer tube. Plot 53 shows rapid temperature rise in the cooling water. In the illustrative experiment, between 93% and 98% of the electric energy was available for food heating either directly through induction heating or indirectly through energy regeneration from the cooling water.

With respect to a boiler system of heating, the system of the present embodiment can provide lower energy cost. Magnetic induction is approximately 95% efficient in converting supply energy to food heat, whereas, based on the BTU's entering a plant as liquid petroleum gas (LPG), the BTUs ultimately residing in food heat, steam is about 20% efficiency. Currently, LPG and fuel oil are cheaper than combustion fuels per kWh as shown below in Table 1.

TABLE 1

| Fuel Costs 3rd Quarter 2007 | | | |
|---|---|---|---|
| | Fuel Oil | LPG (>3.1 tons) | Electricity 1000 kW load, day charge[a] |
| Delivered Energy Cost (cent/kWh) | 5.88 | 7.46 | 15.92 |
| % increase July to October 2007 | +5.4 | +2.8 | +0 |

[a]electricity 1000 kW load, night charge = 7.89 cent/kWh

Although daytime cost for high volume electric energy costs twice as much per kWh more than LPG and 2.7 times more than fuel oil, costs become equivalent at 40 to 60% (respectively) electric power-to-heat conversion efficiency for induction heating. Night charges for electricity are even more favorable and are similar with LPG. Unlike the boiler system, magnetic induction is an on/off unit which goes from cold to target temperature in seconds.

Further, with respect to the boiler system, the system of the present embodiment can provide lower equipment cost. The magnetic induction unit of the present embodiment can replace the boiler system, steam transfer lines, steam valves, steam controllers, and the heat exchanger. A magnetic induction unit sized to a commercial food processing line could be no larger than a refrigerator and could cost a fraction of the boiler system and steam transfer hardware. Still further, with respect to the boiler system, the system of the present embodiment can reduce plant space. Regulations can require that boiler systems be housed in an enclosed room. A commercial magnetic induction unit can be castor-equipped and can, if desired, be relocated from place to place on the processing floor. Without the need for steam transfer lines and other steam-related hardware, further space savings could be recognized. Even still further, personnel savings could be recognized with a magnetic induction system. The boiler system requires a boiler engineer, whereas the magnetic induction unit of the present embodiment could be operated through a computer program by an operator who would require little training. Magnetic induction heating can be adapted to be automatically controlled. Processing temperature can be controlled to within the sensitivity and response time of the thermal measuring device. On the contrary, boiler system controller can require time to respond to temperature fluctuations, which can impact sterility. The magnetic induction system of the present embodiment can respond quickly enough so that low temperature readings mid-coil can be increased by the end of the coil. Also, energy from the pipeline could increase in price as demand increases and supply dwindles. Alternative energy (solar, wind, nuclear, geothermal, hydroelectric etc) is delivered through a grid, not a pipeline. As shown in Table 1, the magnetic induction system of the present embodiment can offer immediate energy savings to food/industrial processors and can prepare processing for an all-electric future. The magnetic induction system of the present embodiment does not require high pressure steam, reducing steam injuries.

Figure 5:
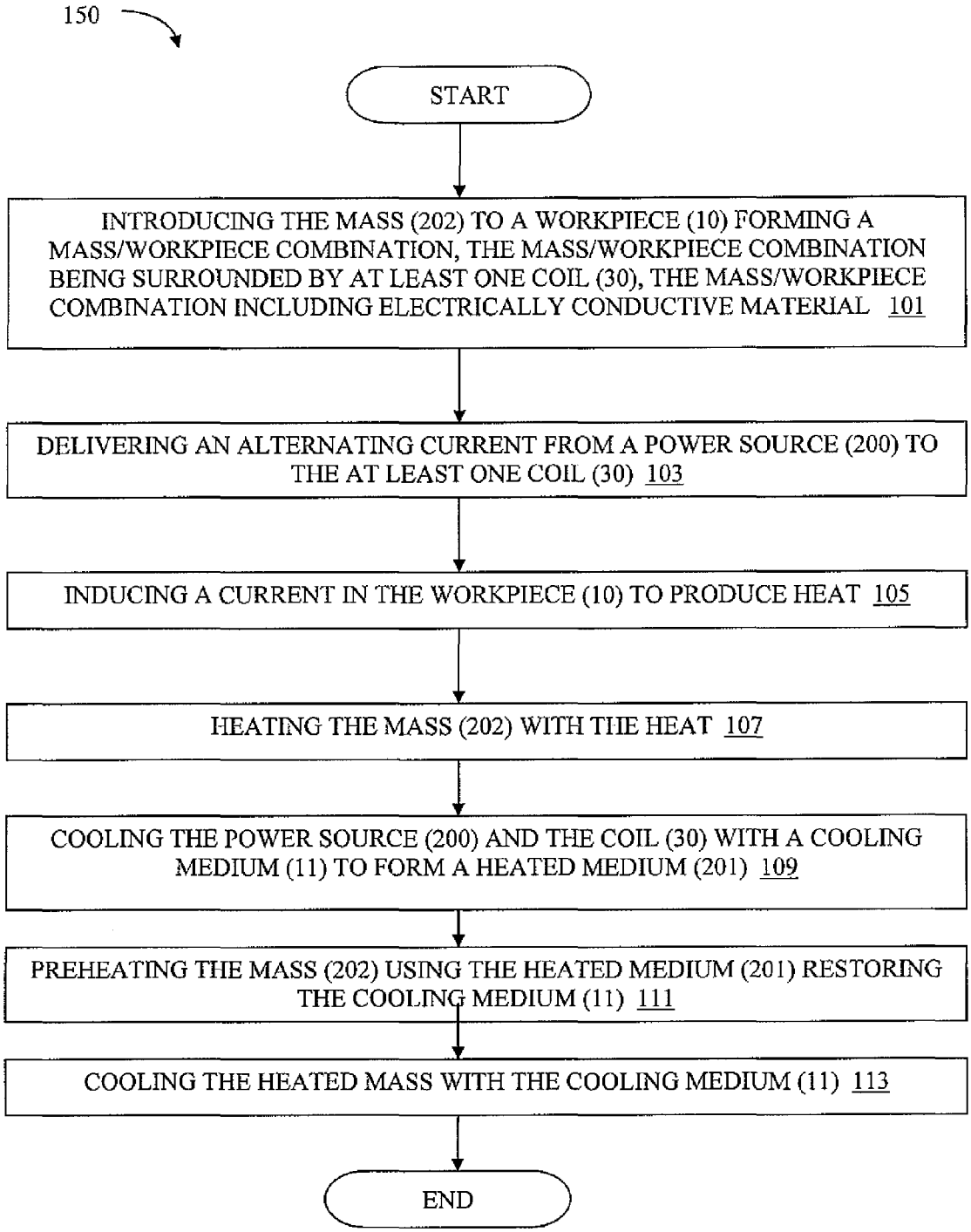
FIG. 5 is a flowchart of the method of use of the magnetic induction device of the present embodiment.

Referring now primarily to FIG. 5, method 150 (FIG. 5) for heating mass 202 (FIG. 1) can include, but is not limited to including, the steps of introducing 101 (FIG. 5) mass 202 (FIG. 1) to workpiece 10 (FIG. 1) forming a mass/workpiece combination, the mass/workpiece combination being surrounded by coil 30 (FIG. 1), the mass/workpiece combination including electrically conductive material, delivering 103 (FIG. 5) an alternating current from power source 200 (FIG. 1) to coil 30 (FIG. 1), inducing 105 (FIG. 5) a current in workpiece 10 (FIG. 1) to produce heat, heating 107 (FIG. 5) mass 202 (FIG. 1) with the heat, cooling 109 (FIG. 5) power source 200 (FIG. 1) and coil 30 (FIG. 1) with cooling medium 11 (FIG. 1) to form heated medium 201 (FIG. 1), preheating 111 (FIG. 5) mass 202 (FIG. 1) using heated medium 201 (FIG. 1) to restore cooling medium 11 (FIG. 1), and cooling 113 (FIG. 5) the heated mass with cooling medium 11 (FIG. 1). Method 150 (FIG. 5) can optionally include the steps of surrounding workpiece 10 (FIG. 1) with tube 20 (FIG. 1), isolating coil 30 (FIG. 1) from workpiece 10 (FIG. 1), providing mass 202 (FIG. 1) to a plurality of channels 14 (FIG. 1) or plates in workpiece 10 (FIG. 1), and sensing the temperature of mass 202 (FIG. 1).

Figure 6:
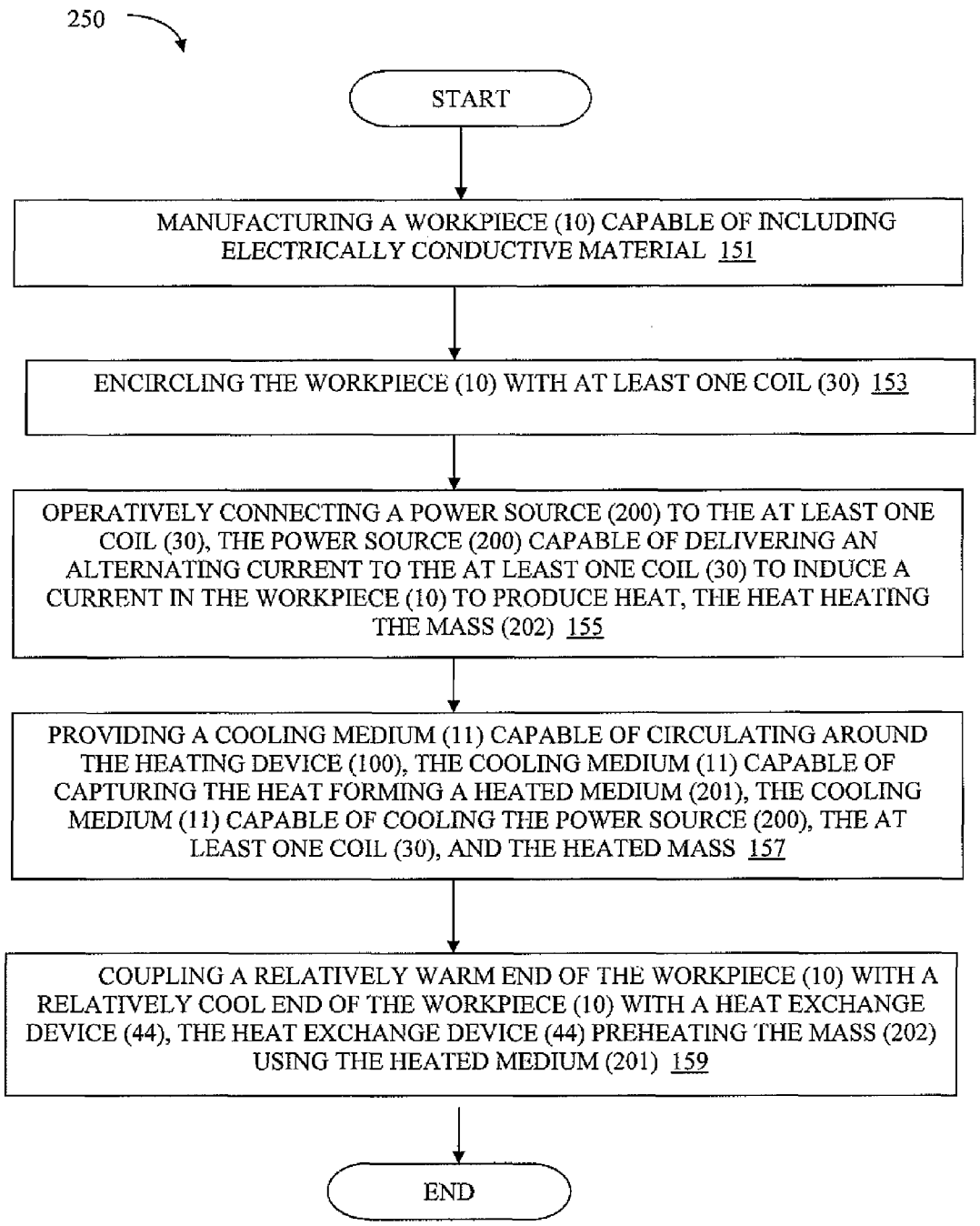
FIG. 6 is a flowchart of the method of making the magnetic induction device of the present embodiment.

Referring now primarily to FIG. 6, method 250 (FIG. 6) for manufacturing heating device 100 (FIG. 1) to heat mass 202 (FIG. 1) include, but is not limited to including, the steps of manufacturing 151 (FIG. 6) workpiece 10 (FIG. 1) capable of including electrically conductive material, encircling 153 (FIG. 6) workpiece 10 (FIG. 1) with coil 30 (FIG. 1), operatively connecting 155 (FIG. 6) power source 200 (FIG. 1) to coil 30 (FIG. 1). Power source 200 (FIG. 1) can deliver an alternating current to coil 30 (FIG. 1) to induce a current in workpiece 10 (FIG. 1) to produce heat which can heat mass 202 (FIG. 1). Method 250 (FIG. 6) can further include the step of providing 157 (FIG. 6) cooling medium 11 (FIG. 1) that can circulate around heating device 100 (FIG. 1). Cooling medium 11 (FIG. 1) can capture the heat forming heated medium 201 (FIG. 1). Cooling medium 11 (FIG. 1) can cool power source 200 (FIG. 1), coil 30 (FIG. 1), and the heated mass. Method 250 (FIG. 6) can further include the step of coupling 159 (FIG. 6) a relatively warm end of workpiece 10 (FIG. 1) with a relatively cool end of workpiece 10 (FIG. 1) by heat exchanger 44 (FIG. 1). Heat exchanger 44 (FIG. 1), which can be, for example, but not limited to, a tube-in-shell heat exchanger, can preheat mass 202 (FIG. 1) using heated medium 201 (FIG. 1). Method 250 (FIG. 6) can optionally include the steps of manufacturing workpiece 10 (FIG. 1) from electrically conductive material, fitting workpiece 10 (FIG. 1) inside tube 20 (FIG. 1), and isolating coil 30 (FIG. 1) from tube 20 (FIG. 1). Method 250 (FIG. 6) can further optionally include the steps of manufacturing tube 20 (FIG. 1) from dielectric material, surrounding power source 200 (FIG. 1) with insulation, including a plurality of channels 14 (FIG. 1) or plates in workpiece 10 (FIG. 1), and operatively coupling temperature sensor 32 (FIG. 3) with mass 202 (FIG. 1).

What has been described and illustrated herein are embodiments of the magnetic induction system. The terms, descriptions and figures used herein are set forth by way of illustration only and are not meant as limitations. Those skilled in the art will recognize that many variations are possible within the spirit and scope of the teachings herein in which all terms are meant in their broadest, reasonable sense unless otherwise indicated. Any headings utilized within the description are for convenience only and have no legal or limiting effect. Therefore, the foregoing is considered as illustrative only of the principles of the present teachings. Further, since numerous modifications and changes will readily occur to those skilled in the art, it is not desired to limit the present teachings to the exact construction and operation shown and described, and accordingly, all suitable modifications and equivalents may be resorted to, falling within the scope of the present teachings.

What is claimed is:

1. A method for heating a mass comprising the steps of:

introducing the mass to a workpiece which facilitates heat exchange forming a mass/workpiece combination, the mass/workpiece combination being surrounded by at least one coil, the mass/workpiece combination including electrically conductive material;

delivering an alternating current from a power source to the at least one coil; inducing a current in the mass/workpiece combination to produce heat;

heating the mass with the heat;

cooling the power source and the at least one coil with a cooling medium to form a heated medium;

preheating the mass using the heated medium restoring the cooling medium; and cooling the heated mass with the cooling medium.

2. The method as in claim 1 further comprising the step surrounding the mass/workpiece combination with a tube.

3. The method as in claim 1 further comprising the step of: isolating the at least one coil from the workpiece.

4. The method as in claim 1 wherein said step of introducing the mass further comprises the step of:

introducing the mass to a plurality of channels in the workpiece; wherein the plurality of channels allows flow and intimate contact to take place between the mass and the workpiece.

5. The method as in claim 1 wherein said step of introducing the mass further comprises the step of:

introducing the mass to a plurality of plates in the workpiece; wherein the plurality of plates allows flow and intimate contact to take place between the mass and the workpiece.

6. The method as in claim 1 further comprising the step of: sensing the temperature of the mass by a feedback circuit.

7. A method for manufacturing a heating device to heat a mass comprising the steps of:

manufacturing a workpiece which facilitates heat exchange and is capable of including electrically conductive material;

encircling the workpiece with at least one coil;

operatively connecting a power source to the at least one coil, the power source capable of delivering an alternating current to the at least one coil to induce a current in the workpiece to produce heat, the heat heating the mass;

providing a cooling medium capable of circulating around the heating device, the cooling medium capable of capturing the heat forming a heated medium, the cooling medium capable of cooling the power source, the at least one coil, and the heated mass; and coupling a first end of the workpiece with a second end of the workpiece which is cooler than the first end of the workpiece by a heat exchanger, the heat exchanger preheating the mass using the heated medium restoring the cooling medium.

8. The method as in claim 7 farther comprising the steps of: manufacturing the workpiece from electrically conductive material;

fitting the workpiece inside a tube; and isolating the at least one coil from the tube.

9. The method as in claim 8 further comprising the step of: manufacturing, the tube from dielectric material.

10. The method as in claim 7 further comprising the step of: surrounding the power source with insulation.

11. The method as in claim 7 further comprising the step of: including a plurality of channels in the workpiece; wherein the plurality of channels allows flow and intimate contact to take place between the mass and the workpiece.

12. The method as in claim 7 further comprising the step of: including a plurality of plates in the workpiece; wherein the plurality of plates allows flow and intimate contact to take place between the mass and the workpiece.

13. The method as in claim 7 further comprising the step of: operatively coupling at least one feedback circuit comprising a temperature sensor with the mass.

14. A heating device for heating a solid or liquid mass comprising:

a workpiece which facilitates heat exchange to which the solid or liquid mass is introduced, said workpiece and the solid or liquid mass forming a solid or liquid mass/workpiece combination, the solid or liquid mass/workpiece combination including electrically conductive material:

at least one coil surrounding the solid or liquid mass/workpiece combination;

a power source delivering an alternating current to said at least one coil, said alternating current inducing a current in the mass/workpiece combination to produce heat, said heat heating the solid or liquid mass; and a cooling medium capturing said heat and forming a heated medium; said cooling medium cooling the power source, said at least one coil, and the heated medium; wherein the cooling of the power source, said at least one coil and the heated medium transforms said cooling medium into said heated medium; said heated medium heating the solid or liquid mass.

15. The heating device as in claim 14 further comprising:

a tube surrounding the solid or liquid mass/workpiece combination, said tube being isolated from said at least one coil, said tube including dielectric material.

16. The heating device as in claim 14 wherein said workpiece further comprises a plurality of channels; wherein the plurality of channels allows flow and intimate contact to take place between the solid or liquid mass and the workpiece.

17. The heating device as in claim 14 wherein said workpiece further comprises a plurality of plates; wherein the plurality of plates allows flow and intimate contact to take place between the solid or liquid mass and the workpiece.

18. The heating device as in claim 14 further comprising: insulation surrounding said power source.

19. The heating device as in claim 14 further comprising: at least one feedback circuit comprising a temperature sensor.

20. The heating device as in claim 14 wherein said cooling medium comprises water, and wherein said heated medium comprises water.

* * * * *